United States Patent [19]

Gibson

[11] Patent Number: 5,043,687

[45] Date of Patent: Aug. 27, 1991

[54] ADJUSTABLE WALKING BEAM INTERLOCK MECHANISM

[75] Inventor: Jeffrey S. Gibson, Aliquippa, Pa.

[73] Assignee: Westinghouse Electric Corp., Pittsburgh, Pa.

[21] Appl. No.: 583,111

[22] Filed: Sep. 17, 1990

[51] Int. Cl.[5] ..... H01H 9/20

[52] U.S. Cl. ..... 335/160; 335/161; 200/50 C

[58] Field of Search ..... 335/159, 160, 161; 200/50 C, 50 AA

[56] References Cited

U.S. PATENT DOCUMENTS

| | | | |
|---|---|---|---|
| 2,904,649 | 9/1959 | Ranson | 200/50 C |
| 3,710,288 | 1/1973 | Grunert . | |
| 4,286,242 | 8/1981 | Mrenna et al. | 335/160 |
| 4,499,344 | 2/1985 | Castonguay et al. | 335/161 |
| 4,516,100 | 5/1985 | Wallace et al. | 335/160 |
| 4,528,531 | 7/1985 | Flick et al. | 335/23 |
| 4,598,264 | 7/1986 | Suter | 335/159 |
| 4,665,284 | 5/1987 | Guinan | 200/50 C |
| 4,760,278 | 7/1988 | Thomson | 200/50 AA |
| 4,827,089 | 5/1989 | Morris et al. | 200/50 C |
| 4,902,859 | 2/1990 | Witzmann et al. | 200/50 C |
| 4,924,041 | 5/1990 | Yee | 200/50 C |

*Primary Examiner*—Leo P. Picard
*Assistant Examiner*—Lincoln Donovan
*Attorney, Agent, or Firm*—C. M. Lorin

[57] ABSTRACT

A walking beam for interlocking control devices such as circuit breakers is characterized by a central bracket for supporting, on a mounting plate of the control devices, the beam through its central pin, and a single screw is provided for adjusting the central pin level within the bracket until the plungers at the two ends of the beam are fully engaged with their respective control members, which could be the crossbars of a circuit breaker. Once the walking beam has been properly adjusted, the central pin and the screw are fixed in position with nuts.

6 Claims, 3 Drawing Sheets

ADJUSTABLE WALKING BEAM INTERLOCK MECHANISM

BACKGROUND OF THE INVENTION

When several circuit breakers are working in parallel, there may be a requirement to interlock two breakers so that when one is being turned ON, the other is turned OFF, so that only one may be closed (ON) at a time.

There are three most common types of mechanical interlocks: the walking beam, the sliding bar and the key interlock. The sliding bar interlock is typified by U.S. Pat. Nos. 4,516,100; 4,295,053 and 4,286,242. Typical of the walking beam interlock is U.S. Pat. No. 3,710,288. As illustrated, for instance, in U.S. Pat. Nos. 4,286,242 and 4,516,100, the sliding bars control reciprocal plungers which connect with corresponding control members of the parallel circuit breakers so that when one control member is brought to the closed position (ON), the other control member is automatically pulled away by its associated plunger toward the open position (OFF). In U.S. Pat. No. 3,710,188 is described a lever pivoting centrally with its two ends achieving the same opposite ON and OFF positions for a contactor. The same result could be obtained through a plunger at each of these two ends. The plungers have been shown in U.S. Pat. Nos. 4,516,100; 4,286,242 and 4,295,053 engaging directly the moveable contact carrier or moveable arm of the circuit breaker. Indeed, the plungers may be interfaced instead with the crossbar arm which, in a circuit breaker, is known to cause the moveable contact arm to be moved to the closed (ON) or to the open (OFF) position.

The present invention relates to initially adjusting the interlock walking beam of a circuit breaker so as to provide an exact and opposite relationship between ON and OFF positions, once the opposite circuit breakers are operating in parallel. This problem has been considered in U.S. Pat. No. 3,710,288, considering a mechanical interlock in the context of the operation of reversible speed motors controlled by contactors which should not be actuated simultaneously. The problem considered here has to do with adjusting a mechanical interlock on a back panel, or control board, between contactors of different size and/or manufacturers. Adjustment means are provided for compensating for different thicknesses or irregularities, or for tolerances, in the mounting surfaces. In this regard, the '288 patent shows the use of a bracket with slots and several screws which allow positioning of the lever and setting the central pivot at the proper distance relative to the operating contacts to be actuated upon at both ends of the lever. The present invention proposes a simpler mounting of the walking beam, and calls for a single screw adjustment, by the operator, of a walking beam associated with parallel circuit breakers, or contactors.

SUMMARY OF THE INVENTION

The invention is applicable to an electric control system including: at least two control devices, each operating between an ON and an OFF position under positioning of respective control members, and mechanical interlock means to be mechanically coupled with said control members for causing one control device to assume the OFF position when the other control device is being set into the ON position.

The mechanical interlock means comprises: a lever pivotally connected about a central pin; plungers mounted at the respective ends of said lever, each for symmetrically engaging a corresponding one of the control members; a mounting plate for supporting the lever; a bracket mounted upon the mounting plate for mechanically interconnecting mounting plate and central pin into a parallel relationship, the central pin being slidably mounted in said bracket in a plane normal to said mounting plate and parallel to said plungers. The bracket has a spiral groove about an axis situated in said plane and normal to said mounting plate and a screw is provided which is complementary of said spiral groove and mounted therein for initially applying a force along said axis upon said central pin to displace said plungers while orienting said lever, whereby both plungers come into engagement with the control members. Means is provided on the bracket for fixing the lever and the pin into position thereafter.

DETAILED DESCRIPTION OF THE INVENTION

Figure 1A:
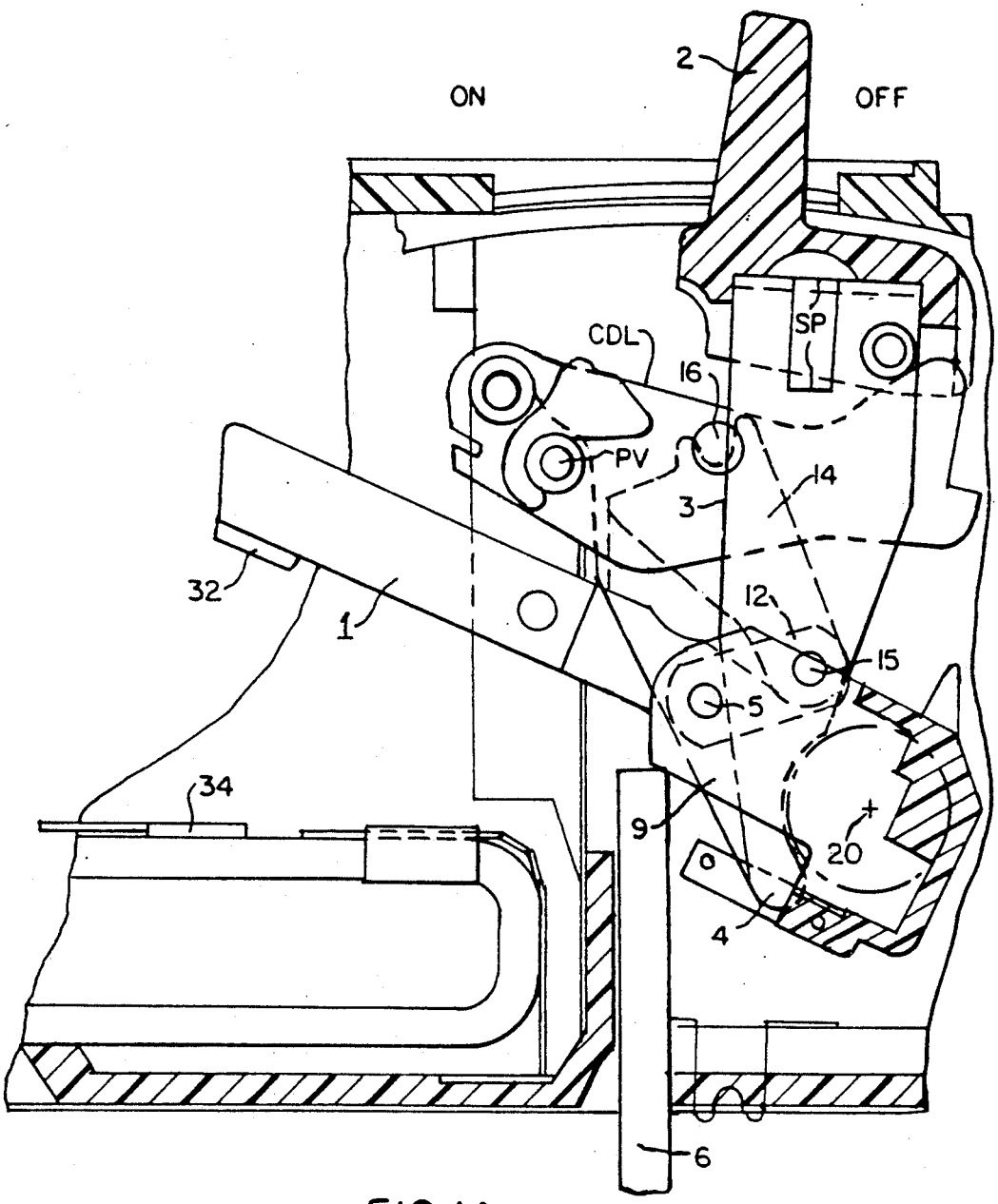
FIGS. 1A and 1B show in cross-section two identical circuit breakers with their crossbar and a controlling plunger for the open contacts (OFF) and the closed contacts (ON) positions, respectively.
Figure 1B:
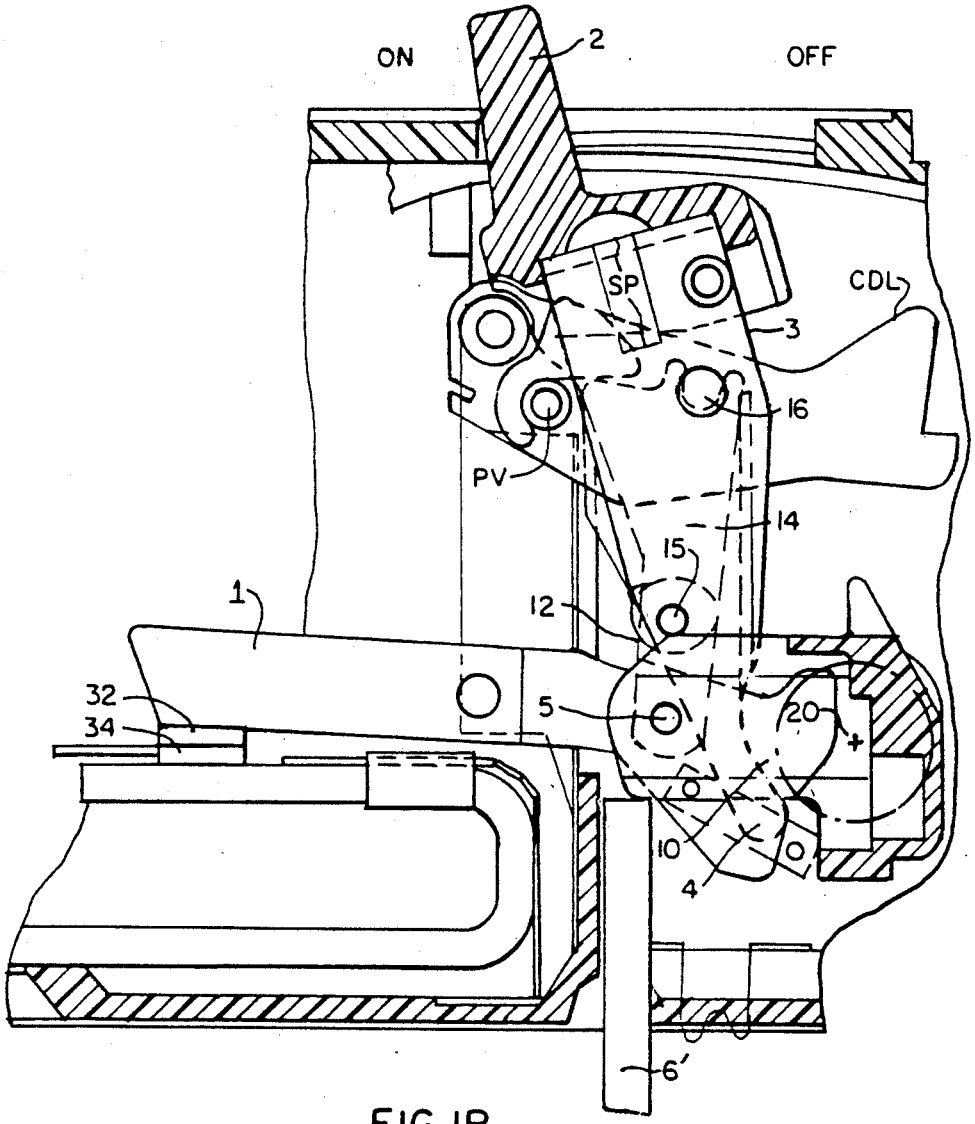

Referring to FIGS. 1A and 1B, two identical circuit breakers are shown, one with the movable contact 32 away from the fixed contact 34 (in FIG. 1A), the other with the two contacts closed (in FIG. 1B). The object of the present invention is to have the two circuit breakers working side-by-side, one being ON when the other is OFF, never two ON at the same time. For instance, this is a requirement for two circuit breakers chosen to correspond to the opposite modes of a motor having reversible speeds. The type of circuit breaker illustrated in FIG. 1A or 1B has its movable contact carried by a contact carrier 1 which can rotate about a pivot 20 which is at the center of the crossbar (9 in FIG. 1A; 10 in FIG. 1B) of the circuit breaker. A plunger (6 on FIG. 1A, 6' on FIG. 1B) is used, according to the present invention, in order either to push the crossbar OFF, so that the contacts go to the open position, under the interlocking action of the lever, or to be pushed by the crossbar when going to the ON position. Control of the movable arm 1 by a crossbar is well known. As illustrated in FIGS. 1A and 1B, a toggle mechanism comprising a lower toggle link 12 and an upper link 14 shall fold if the handle 2 is pulled from the ON position to the OFF position. This is caused by a spring (not shown) which extends between the central pivot 15 of the toggle mechanism and a point of fixation SP at the top of the handle arm 3 as the latter pivots about a pivot, or knee articulation at 4. This spring will pull the joint 15 of the toggle mechanism once the handle arm 3 has passed to the right a deadline marked by midpoint pivot 15 and upper pivot 16. When folding occurs, the lower link pivot 5 will raise the contact carrier 1, as shown in FIG. 1A. Control to close the contacts will occur by turning the crossbar in the clockwise direction. This may be caused by handle control. It may also occur by automatic tripping which, as generally known, will cause the cradle (CDL on FIGS. 1A and 1B) to rotate (counterclockwise around pivot PV, as shown) and move the upper link pivot 16 to the left, thereby enabling, under the spring, a collapse of the toggle mechanism about its midpoint 15. For the purpose of disclosing the full operation of a circuit breaker under control of a crossbar, U.S. Pat. No 4,528,531 is hereby incorporated by reference. FIGS. 3 and 14 of this incorporated-by-reference U.S. patent show the crossbar in its ON and OFF positions, respectively. Although plungers 6 and 6' have been shown in FIGS. 1A and 1B engaging the crossbar (10 and 9, respectively) of an associated circuit breaker, other designs are possible for converting longitudinal movement of a bar, rod, or plunger into rotation for the movable contact carrier. See for instance U.S. Pat. No. 4,516,100. It is also conceivable to directly push the movable contact carrier, as shown in U.S. Pat. No. 4,295,053. Although the invention will be described as applicable to a circuit breaker, it is also possible to use the invention with electrical contactors. See for instance U.S. Pat. No. 3,710,288 wherein "closedcircuit" and "open-circuit" positions are determined between two parallel contactors with an interlocking lever pivoting about a midpoint pin.

Figure 2:
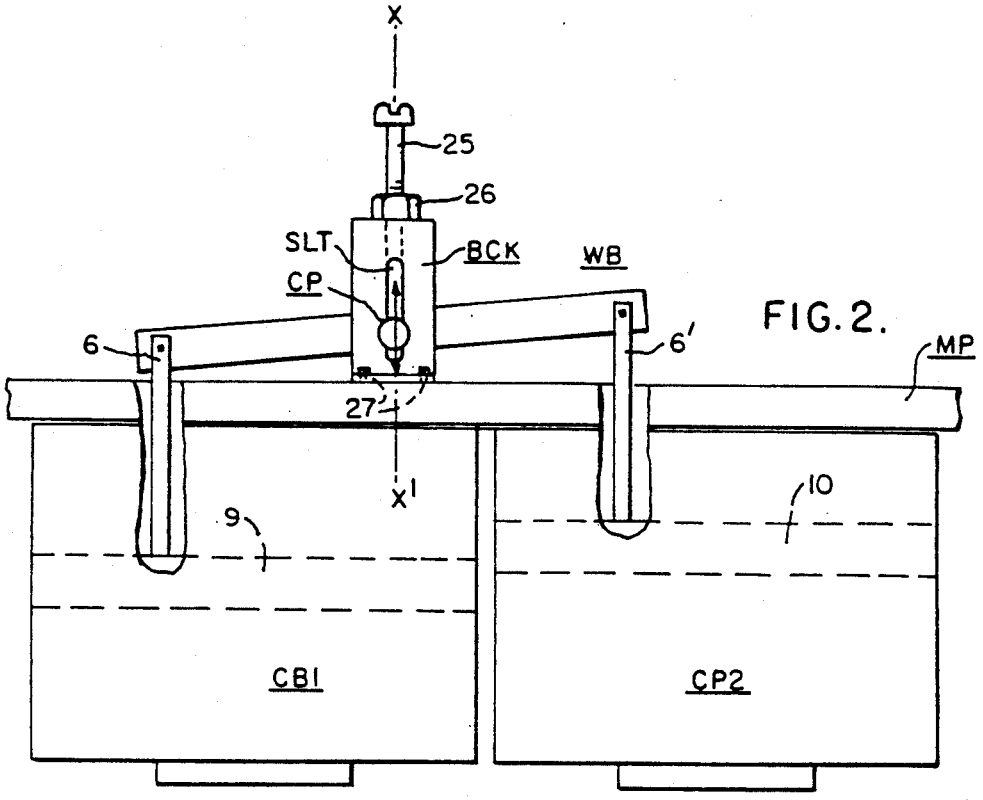
FIG. 2 illustrates the walking beam according to the present invention as could be used with the plungers shown in FIGS. 1A and 1B.

Referring to FIG. 2, the walking beam WB according to the present invention is shown mounted upon a mounting plate MP which is part of an assembly of two circuit breakers CB1 and CB2 operating in parallel with the common condition that when one circuit breaker is turned ON, the other should be turned OFF. The assembly of circuit breakers includes a mounting plate having two holes HLS admitting therethrough two plungers 6 and 6' one for circuit breaker CB1, the other for circuit breaker CB2. In the housing of each circuit breaker there is a control member, typically the crossbar 9 in CB1, 10 in CB2. As illustrated, member 9 is positioned for the OFF position (contacts opened) and member 10 for the 0N position (contacts closed). The plunger engages at all time the front surface of the associated member. The intended result is that when one member (9 or 10) moves by pushing its plunger, the other member will be pushed back by the other plunger. This is achieved through the lever action of the walking beam WB pivoting about its central pin CP. Should circuit breaker CB1, (initially in the OFF position) be controlled (by manual control of the handle 2, or by tripping upon the cradle CDL of FIG. 1A) by the member (crossbar 9 in FIG 1A) to close the contacts (32 and 34), the plunger 6 will be pushed back (upward in FIG. 2) and the walking beam WB will force the other plunger 6' of FIG. 1B to move upward (in FIG. 2, it will be downward since the circuit breakers have been shown upside down), thereby causing member 10 to take the OFF position (in FIG. 1A the crossbar will rotate counterclockwise and contacts 32 and 34 will close under the contact carrier 1, whereby in FIG. 1B the crossbar 10 will rotate clockwise to the OFF position). This inversion of the respective member positions by a walking beam is not new. See, for instance, the aforementioned U.S. Pat. No. 3,710,288.

Figure 2B:
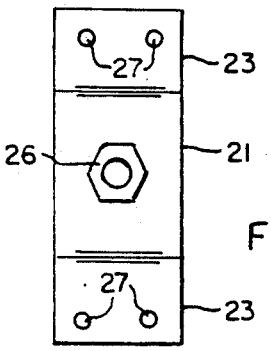
FIGS. 2A, 2B and 2C are the front view and two side views of the bracket shown in FIG. 2, respectively.
Figure 2C:
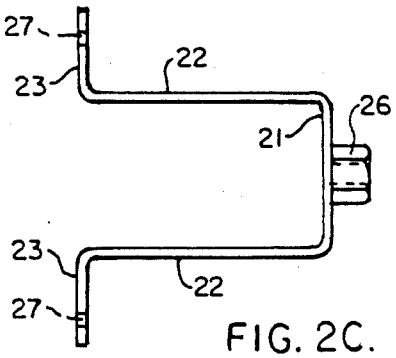
Figure 2A:
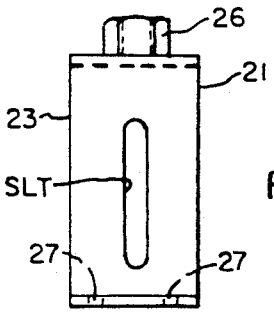

The present invention relates to mounting and adjustment of the walking beam upon the mounting plate MP in relation to the two circuit breakers CB1 and CB2. A bracket BCK, holding the central pin CP of the beam in opposite slots SLT, is mounted on the plate with a general axis XX' parallel to the two plungers 6 and 6'. The bracket BCK is shown by FIGS. 2A, 2B and 2C which are the front and the two side views thereof, respectively. It is illustrated as a U-shaped bracket with two leg portions 22 joined on one side by a bight portion 21 and having respective flanges 23. Each flange has at least one hole 27 chosen to accommodate a screw to be inserted into the plate MP for fixing the bracket in position thereupon at a location which is equidistant from the holes reserved for the plungers 6 and 6'. The bight portion 21 has a central orifice carrying a rounded nut 24 having internally a spiral groove reserved for a screw 25 (FIG. 2) to be screwed along the axis XX', once the bracket has been positioned. The U-shaped bracket accommodates the walking beam WB between the two leg portions, with its central pin CP passed and engaged at each end into a vertical and longitudinal slot SLT of the associated leg portion. Once the beam has been placed inside the bracket, with the central pin placed so as to glide transversely within the opposite slots, and after the two plungers have been passed through the mounting plate holes HLS, the bracket is fixed upon the mounting plate MP with screws in the holes 27 of the flanges. At this time, it is assumed that one circuit breaker is 0N and the other is OFF, as shown in FIG. 2. One plunger will possibly encounter the highest member (10 in FIG. 2) and the other the lowest member (9). The length of the two slots SLT leaves a sufficient margin, for a given orientation of the beam, that the operator, while turning screw 25 along axis XX', can feel whether the two plungers (6, 6') have become exactly and properly engaged with members (9, 10). At that moment, the central pin CP will have been positioned exactly where it should along the slots SLT. Then, the walking beam (with plungers, lever and central pin) is correctly positioned. It remains for the operator to fix the screw and the central pin in position. This is done with a nut 26 mounted on the screw 25 holding the screw 25 in position within the bracket BCK. It is clear that, once such exact initial position has been permanently established for the walking beam WB and the plungers (6, 6'), the operation of the circuit breakers CB1 and CB2 will be perfectly coordinated by the two plungers, although they are merely engaging respective surfaces of the members (9 and 10).

The disclosed walking beam is applicable to interlocking of a plurality of control devices such as contactors, circuit breakers, or any pair of devices which are to adopt opposite stable states by interlocking. The circuit breakers may be of the two-pole, or of the three-pole type, the crossbar controlling the associated units at the same time so as to connect, or disconnect the connection between the load and the multiphase power lines. Indeed, more than one walking beam may be installed to interlock more than one pair of control devices.

I claim:

1. In an electric control system including: at least two control devices, each operating between an ON and an OFF position under positioning of respective control members, and mechanical interlock means to be mechanically coupled with said control members for causing one control device to assume the OFF position when the other control device is being set into the ON position; and a mounting plate assembled in front of said control devices; the provision of:

mechanical interlock means comprising: a lever pivotally connected about a central pin; plungers mounted on the respective ends of said lever each for symmetrically engaging a corresponding one of said control members; a bracket mounted upon said mounting plate for mechanically interconnecting said mounting plate and said central pin in a parallel relationship, said central pin being slidably mounted within said bracket for parallel movement in a plane normal to said mounting plate and parallel to said plungers;

spiral groove means provided on said bracket about an axis situated in said plane and normal to said mounting plate;

a screw complementary to said spiral groove means mounted therewith for initially applying a force along said axis upon said central pin to displace said plungers while orienting said lever, so as to place both plungers into engagement with said control members; and means on the bracket for fixing the lever and the pin into position thereafter.

2. The system of claim 1 with said control devices being circuit breakers and said control members being corresponding crossbar means.

3. The system of claim 2 with at least two circuit breakers being associated with a common one of said crossbar means for control by a common one of said plungers.

4. The system of claim 3 with said bracket being a U-shaped support having two leg portions connected at one end by a bight portion and each having a flange portion; said bight portion having a central opening for receiving said screw; said bracket being mounted upon said mounting plate through said flange portions; and said spiral groove means being provided about said bight portion opening.

5. The system of claim 4 with said fixing means including a nut counteracting with said screw within said spiral groove means.

6. The system of claim 5 with said leg portions each having a longitudinal slot parallel to said axis, said slots admitting said central pin from both ends for sliding movement therealong.

* * * * *